US006190073B1

(12) United States Patent
Kabigting

(10) Patent No.: US 6,190,073 B1
(45) Date of Patent: Feb. 20, 2001

(54) LONG HANDLED LOTION APPLICATOR

(76) Inventor: Pearl Kabigting, 1086 W. King Rd., #F115, Malvern, PA (US) 19355

( * ) Notice: Under 35 U.S.C. 154(b), the term of this patent shall be extended for 0 days.

(21) Appl. No.: 09/537,924

(22) Filed: Mar. 29, 2000

(51) Int. Cl.[7] ..... A46B 5/02

(52) U.S. Cl. ..... 401/6; 401/181; 401/176; 401/138; 401/139

(58) Field of Search ..... 401/6, 139, 138, 401/137, 176, 179, 180, 181, 261, 266, 263; 239/289, 526, 319; 222/390

(56) References Cited

U.S. PATENT DOCUMENTS

| | | | | |
|---|---|---|---|---|
| D. 320,490 | * | 10/1991 | Andrew, III et al. | D32/45 |
| 2,438,843 | * | 3/1948 | Correa | 401/139 |
| 2,707,292 | * | 5/1955 | Lustbader | 401/139 |
| 2,832,086 | * | 4/1958 | Wells | 410/139 |
| 3,451,757 | * | 6/1969 | Stroud et al. | 401/139 |
| 4,483,636 | * | 11/1984 | Meyer | 401/266 |
| 5,087,138 | | 2/1992 | Terbrusch et al. | 401/206 |
| 5,088,849 | | 2/1992 | Johnson et al. | 401/44 |
| 5,353,819 | | 10/1994 | Kahn et al. | 132/320 |
| 5,568,669 | | 10/1996 | Godown | 14/143.1 |
| 5,673,455 | | 10/1997 | Per-Lee et al. | 15/210.1 |

* cited by examiner

*Primary Examiner*—Henry J. Recla
*Assistant Examiner*—Huyen Le
(74) *Attorney, Agent, or Firm*—Henderson & Sturm LLP

(57) ABSTRACT

A long handled applicator (10) for spreading lotion in a smooth fashion on the surface of person's body wherein the application (10) includes an elongated tapered housing member (20) having an inboard end (21) and a downwardly angled outboard end (22) provided with a lotion reservoir (28) which communicates with a nozzle element (25) disposed proximate to, but spaced from the outboard end (22) of the housing member (20) which is further provided with a non-porous generally flexible spreader blade member (50) which allows all of the lotion dispensed through the nozzle element (25) to be applied to the surface of a person's skin.

6 Claims, 1 Drawing Sheet

LONG HANDLED LOTION APPLICATOR

BACKGROUND OF THE INVENTION

1. Field of the Invention

The present invention relates to the field of applicators having self-contained fluid reservoirs in general, and in particular to a long handled lotion applicator wherein the fluid reservoir is disposed in the head of the applicator.

2. Description of Related Art

As can be seen by reference to the following U.S. Pat. Nos. 5,087,138; 5,088,849; 5,353,819; 5,568,669; and 5,673,445, the prior art is replete with myriad and diverse long handled applicators having self-contained fluid reservoirs.

While all of the aforementioned prior art constructions are more than adequate for the basic purpose and function for which they have been specifically designed, they are uniformly deficient with respect to their failure to provide a simple, efficient, and practical applicator that insures that all of the liquid that is dispensed from the internal reservoir is available for spreading on a desired surface.

Virtually all of the prior art applicator constructions employ some sort of porous applicator pad which by virtue of the porous surface will of necessity retain a portion of the liquid that is intended to be transferred to another surface.

In addition, there is a distinct possibility that the applicator liquid employed will congeal within the pores thereby reducing both the liquid capacity and the normal flexibility of the porous applicator rendering its performance below acceptable levels.

As a consequence of the foregoing situation, there has existed a longstanding need for a new and improved long handled lotion applicator which utilizes a non-porous squeegee style applicator blade to spread lotion that is dispensed from an internal liquid reservoir, and the provision of such a construction is a stated objective of the present invention.

BRIEF SUMMARY OF THE INVENTION

Briefly stated, the long handled lotion applicator that forms the basis of the present invention comprises in general, a housing unit which contains a lotion dispensing unit and is further provided with a lotion spreader unit which cannot absorb any of the lotion that is dispensed from the housing unit by the dispensing unit.

As will be explained in greater detail further on in the specification, the housing unit includes an elongated housing member having a relatively narrow rear end provided with finger grip recesses and a generally enlarged downwardly angled front end equipped with the lotion spreader unit and having an internal lotion reservoir provided with a nozzle element that is disposed both above and behind the lotion spreader unit.

The lotion spreader unit comprises a non-porous generally flexible squeegee style applicator blade member which cannot absorb any of the lotion and is further designed to smoothly spread the lotion on a person's skin.

In addition, the lotion dispenser unit includes a piston plate member moveably disposed within the lotion reservoir for forcing metered amounts of lotion through the nozzle element under the influence of an elongated flexible shaft surrounded by a helical spring and provided with a plunger button for advancing the piston plate member within the lotion reservoir.

BRIEF DESCRIPTION OF THE SEVERAL VIEWS OF THE DRAWINGS

These and other attributes of the invention will become more clear upon a thorough study of the following description of the best mode for carrying out the invention, particularly when reviewed in conjunction with the drawings, wherein.

DETAILED DESCRIPTION OF THE INVENTION

Figure 1:
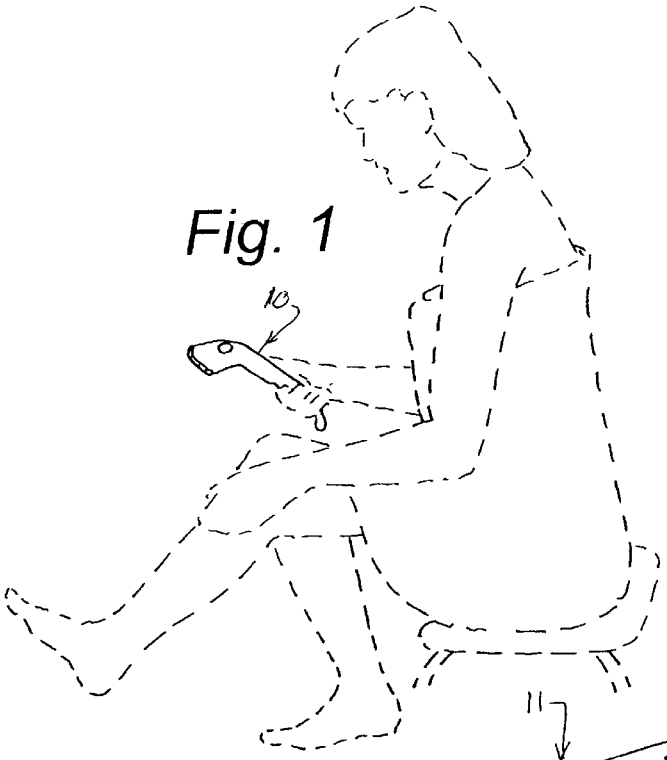
FIG. 1 is a perspective view of the long handled lotion applicator that forms the basis of this invention in use.

As can be seen by reference to the drawings, and in particular to FIG. 1, the long handled lotion applicator that forms the basis of the present invention is designated generally by the reference number 10. The applicator 10 comprises in general a housing unit 11, a dispensing unit 12, and a lotion spreader unit 13. These units will now be described in seriatim fashion.

Figure 2:
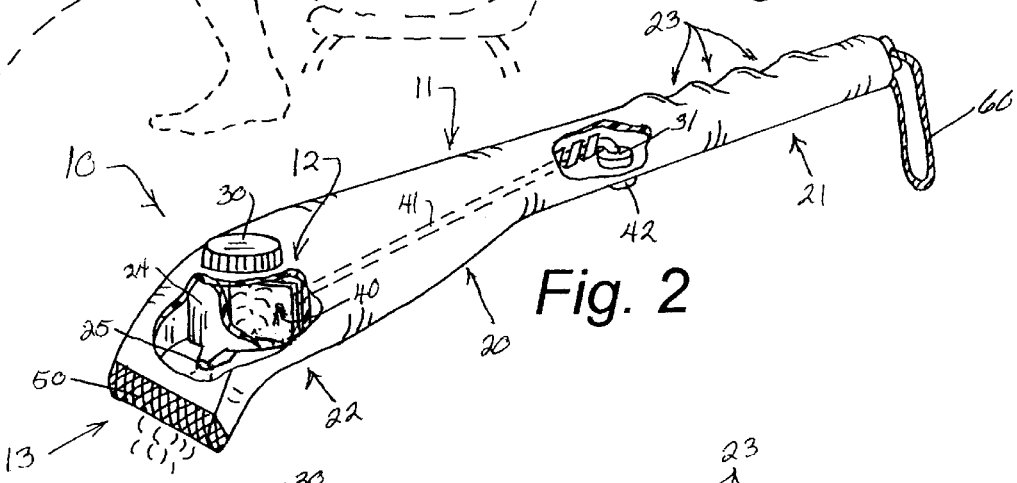
FIG. 2 is a partial cut away perspective view of the lotion applicator exposing portions of the dispensing unit.
Figure 3:
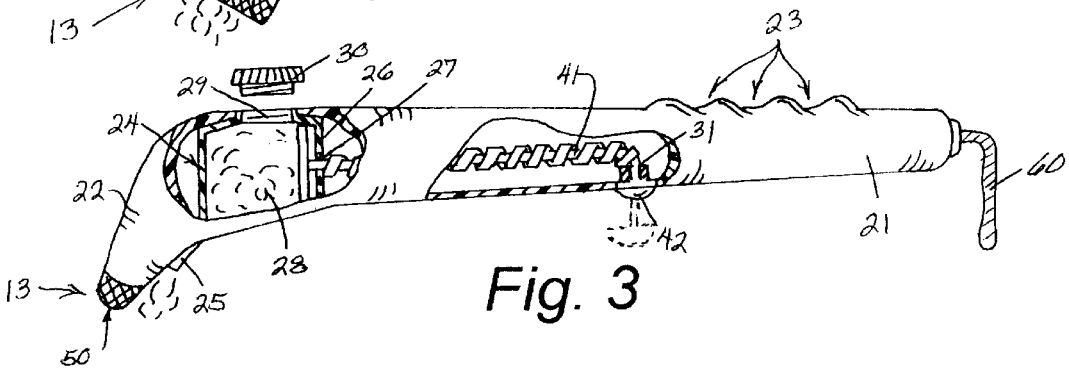
FIG. 3 is a partial cut away side elevation view of the lotion applicator also revealing portions of the dispensing unit.

As shown in FIGS. 2 and 3, the applicator housing unit 11 comprises an elongated generally tapered hollow housing member 20 having a relatively narrow contoured inboard end 21, and a downwardly angled relatively large outboard end 22. The inboard end 21 is provided with a plurality of finger grip recesses 23 to facilitate the user's grasp and manipulation of the applicator 10.

As can also be seen by reference to FIGS. 2 and 3, the enlarged outboard end 22 of the housing member 20 is further provided with a front partition 24 provided with a nozzle element 25 and a rear partition 26 provided with a discrete aperture 27. The front 24 and rear 26 partitions cooperate with the interior walls of the housing member 20 to define a liquid reservoir 28.

In addition, the fluid reservoir 28 is further provided with a threaded opening 29 that is adapted to receive a complementary threaded closure element 30 that allows the liquid within the reservoir 28 to be replenished whenever needed.

Still referring to FIGS. 2 and 3, it can be seen that the dispensing unit 12 comprises a piston plate member 40 disposed within the reservoir 28 and attached on its rear surface to one end of an elongated flexible shaft member 41 dimensioned to pass through the discrete aperture 27 in the rear partition 26 of the reservoir 28.

Furthermore, the other end of the flexible shaft member 41 passes through an opening 31 formed in the vicinity of the inboard end 21 of the housing member 20 and terminates in a plunger button 42 provided to incrementally advance the piston plate member 40 within the liquid reservoir 28 to force metered amounts of liquid through the nozzle element 25 in the front partition 24.

In addition, the flexible shaft member 41 is surrounded by an elongated coiled spring element 43 having one end which bears against the rear partition 27 of the reservoir and the other end of the spring element bears against the interior wall of the housing member 20 adjacent the shaft opening 31.

Figure 4:
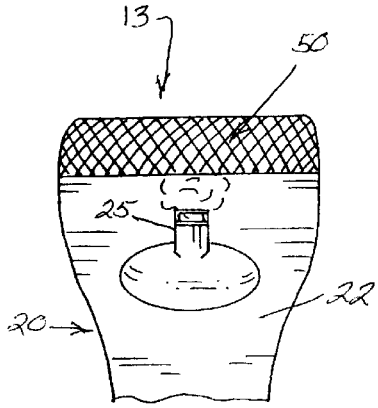
FIG. 4 is an enlarged detail view of the underside of the free end of the lotion applicator.

As shown in FIGS. 2 through 4, the lotion spreader unit 13 comprises a non-porous flexible rubber squeegee style spreader blade member 50 disposed on the downwardly angled outboard end 22 of the housing member 20 at a location forward of and below the outlet of the nozzle element 25 such that when a quantity of lotion is dispensed from the reservoir 28 through the nozzle element 25, it will be deposited on the user's skin at a point behind the spreader blade member 50 such that a rearward movement of the applicator 10 will cause the blade member 50 to smoothly spread the lotion on the surface of a person's body. All of the dispensed lotion is available for application to the user's body due to the non-porous nature of the spreader blade member 50.

Returning once more to FIGS. 2 and 3, it can be seen that the inboard end 21 of the housing member 20 may optionally be provided with a looped cord 60 for hanging the applicator 10 from a hook while not in use.

Although only an exemplary embodiment of the invention has been described in detail above, those skilled in the art will readily appreciate that many modifications are possible without materially departing from the novel teachings and advantages of this invention. Accordingly, all such modifications are intended to be included within the scope of this invention as defined in the following claims.

Having thereby described the subject matter of the present invention, it should be apparent that many substitutions, modifications, and variations of the invention are possible in light of the above teachings. It is therefore to be understood that the invention as taught and described herein is only to be limited to the extent of the breadth and scope of the appended claims.

I claim:

1. A long handled lotion applicator comprising:

a housing unit including an elongated hollow housing member having a relatively narrow inboard end and an enlarged downwardly angled outboard end having a front and rear partition which define a lotion reservoir wherein the front partition is provided with a nozzle element disposed proximate to, but spaced from the outboard end of the housing member;

means for dispensing metered amounts of lotion from the lotion reservoir and through said nozzle element; wherein said means comprises in part: a piston plate member movably disposed within said lotion reservoir for forcing lotion through said nozzle element and wherein said piston plated member has a rear surface connected to one end of an elongated flexible shaft member which is adapted to pass through said rear partition.

2. The applicator as in claim 1 wherein the shaft member has another end which is adapted to pass through the housing member at a location proximate to, but spaced from the inboard end of the housing member.

3. The applicator as in claim 2 wherein said other end of the shaft member terminates in a plunger button which is disposed outside of the housing member.

4. The applicator as in claim 3 wherein said elongated flexible shaft is surrounded by a helical spring element.

5. The applicator as in claim 4 wherein the inboard end of the housing member is provided with a plurality of finger grip recesses.

6. The applicator as in claim 5 wherein the inboard end of the housing member is further provided with a looped cord.

* * * * *